US006074273A

United States Patent [19]

Turner et al.

[11] Patent Number: 6,074,273

[45] Date of Patent: Jun. 13, 2000

[54] NURSING BRA

[76] Inventors: Lorie S. Turner; Gordon B. Turner, Jr., both of 3630 Walhalla Hwy., Six Mile, S.C. 29682

[21] Appl. No.: 09/218,955

[22] Filed: Dec. 22, 1998

[51] Int. Cl.[7] ..... A41C 3/00

[52] U.S. Cl. ..... 450/37; 450/58; 450/57; 2/267

[58] Field of Search ..... 450/37, 39, 40, 450/57, 58; 2/267

[56] References Cited

U.S. PATENT DOCUMENTS

| | | | |
|---|---|---|---|
| 1,989,382 | 1/1935 | Schaittacher | 450/37 |
| 2,258,209 | 10/1941 | De Jorio | 450/37 |
| 2,440,466 | 4/1948 | Freedman | 450/39 |
| 2,502,524 | 4/1950 | Keller | 450/39 |
| 2,522,010 | 9/1950 | Woodruff | 450/39 |
| 5,024,628 | 6/1991 | Sanchez | 450/37 |
| 5,873,767 | 2/1999 | Pickett | 450/1 |
| 5,931,717 | 8/1999 | Lidji | 450/37 |

*Primary Examiner*—Gloria M. Hale
*Attorney, Agent, or Firm*—Hardaway/Mann IP Group

[57] ABSTRACT

A nursing bra having a support body with a front panel comprised of two cups with a pocket in each cup for holding moisture absorbing panels, and a rear panel comprised of two cups with openings in each cup for nursing a baby. The front and rear panel coexist, forming a supportive and comfortable bra. The front panel is removably connected to the rear panel which allows for a portion of the front panel to be lowered away from the rear panel and accessing the openings which surround a woman's nipple for nursing. The pockets in the front panel hold replaceable, moisture absorbing panels that provide a moisture barrier between the woman's body and any other garment the woman may be wearing.

6 Claims, 3 Drawing Sheets

NURSING BRA

BACKGROUND OF THE INVENTION

1. Field of the Invention

This invention relates to nursing bras for women, and more particular bras that provide both support and moisture protection for nursing mothers during periods of lactation.

2. Description of Related Art

The current state of the art provides numerous types of bras for use while nursing infants. Such bras have been patented to Becker (U.S. Pat. No. 2,501,860), Alberts (U.S. Pat. No. 2,679,048) and La Rue (U.S. Pat. No. 2,121,088) and one issued to Strauss (U.S. Pat. No. 206,906) for a corset that allows for breast feeding. Patent issue to Mattson (U.S. Pat. No. 1,094,158) and Fowler (U.S. Pat. No. 5,326,305) both disclose garments with moisture shields to protect from unexpected leakage of lacteal fluids. And patents issued to Richards (U.S. Pat. No. 2,748,771) and Morets et al. disclose a combination of supportive nursing bras having a moisture absorbing pad. The patent issued to Weber-Unger (U.S. Pat. No. 4,164,228) is for a pad to be used with a nursing bra. While all of these references have helped to expand the field of bras some of them disclose a supportive bra, having a removable absorbent pad as claimed in the present invention. The publication, "Clothing and Textiles Research Journal", Vol. 16, #3, 1998, pages 107–108 and 113 also disclose a nursing bra with a removable front panel that allows access to the nipple portion of the bra wearers breast.

It is common for women nursing infant children to experience periods of leakage. Such periods can be untimely and embarrassing. To protect women from such unwanted and inconvenient experiences, the present invention expands the current art in this area by disclosing a bra that is supportive while offering access to the bra wearers breast for nursing as well as removable moisture protection which can easily be replaced.

SUMMARY OF THE INVENTION

In objective of the present invention is to provide a woman's undergarment that is supportive.

Another objective is to provide a bra that is comfortable and unobtrusive when being worn.

It is another objective of the present invention to provide an undergarment having a moisture protective barrier which is easily and quickly replaceable.

And yet another objective of the present invention is to provide a bra that allows for nursing an infant.

These and other objectives are achieved by providing a bra having a support body with two panels; a rear panel having two cups with opening for nursing and the front panel having two cups with pockets for holding moisture absorbing panels. The body has two straps for supporting the bra on the shoulders of the person wearing the bra. Each panel has two front attachment means for attaching the panels together and with the straps. The body also has a rear attachment means for connecting two rear ends or wing portions of the body together. The body is composed of one main portion with two rear wing portions which connect together on the backside of the person wearing the bra. There are also two moisture absorbent panels that are inserted into the two pockets and remain in place until removed.

The aforementioned objectives will be accomplished as well as other features and advantages of the present invention will become more apparent from the following detailed description. The description of the present invention discloses, in conjunction with the drawings which illustrate by way of example, the principles and of the invention.

DESCRIPTION OF THE PREFERRED EMBODIMENT

For a more detailed description of the present invention, reference is made to the figures.

Figure 1:
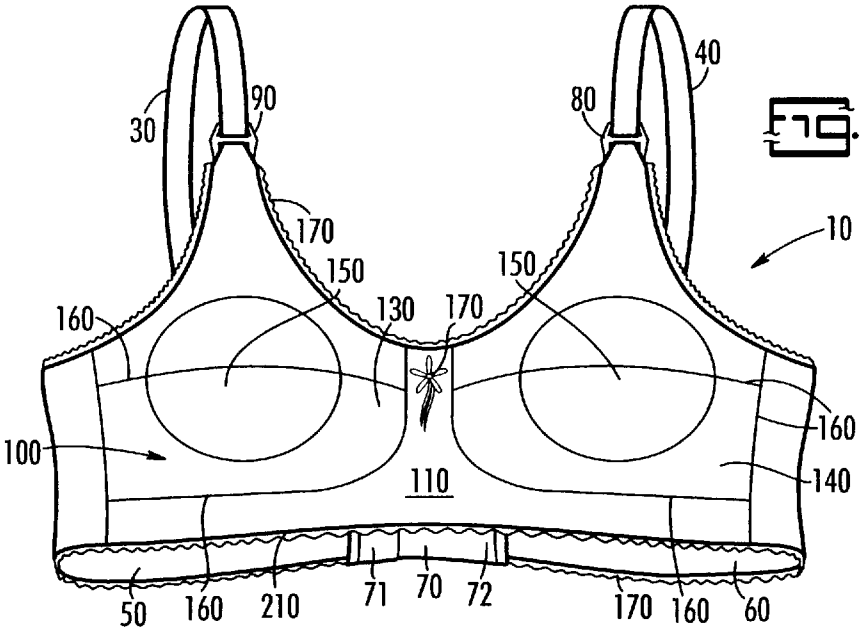
FIG. 1 is a front perspective view of the nursing bra.

FIG. 1 shows a front perspective view of a nursing bra 10 having a body 20 with two straps 30, 40, two rear wing portions 50, 60 and a rear connecting means 70 for connecting the two rear wing portions 50, 60. The connective means is any conventional type known in the art such as hook and loop fasteners, snaps, buttons, hooks, clasps and etc. Each strap 30, 40 is connected to the body 20 in two separate locations, one on a rear wing portion 50, 60 and one on the front portion 100 of the body 20. Where each strap 30, 40 is connected to a rear wing portion 50, 60, the strap is permanently attached. Where each strap 30, 40 is connected to the front portion 100, it is permanently connected to a front panel 110 and removable attached to a rear panel 20 of the body 20. The body 20 is comprised of two panels: a front panel 110 and a rear panel 120. Both front panel 110 and rear panel 120 have the same overall shape and size and lie in communication with each other to form one supportive bra. The front panel 110 has two cups, a right front cup 130 and a left front cup 140, each cup 130, 140 having a holding means such as a pocket or slot 150 for holding a moisture absorbing panel 220 for absorbing leaking fluids from the bra wearers breast. The front panel 110 also has supportive seams 160 stitched around each cup 130, 140, through each cup 130, 140, around each pocket 150 and on each wing 50, 60 between each pocket and each end 71, 72 of the connecting means 70. The front panel 110 may also have a decorative trim 170 if desired. Cup 130 and cup 140 of the front panel 110 are removably connected to strap 30 and strap 40 respectively of the bra 10 so that each cup 130, 140 can be disconnected, either separately or concurrently, to allow the front panel 110 to be folded down to expose the rear panel 120 and the wearers breast as it protrudes and is exposed through the rear panel 120.

Figure 2:
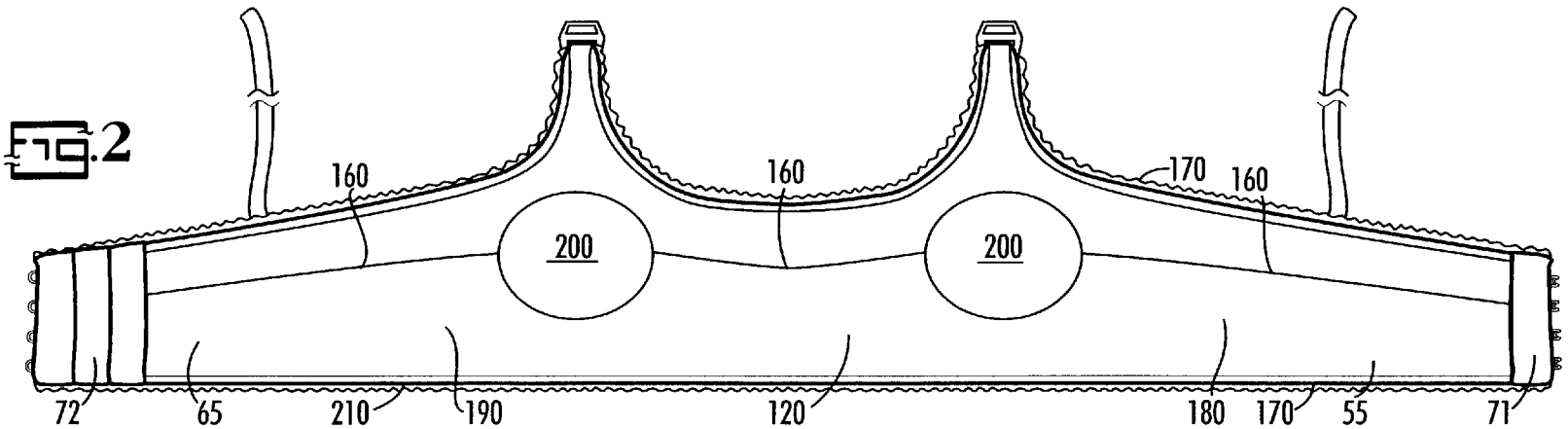
FIG. 2 is a rear elevation view of the rear portion only of the nursing bra.

FIG. 2 is an elevation view of the rear panel 120 of the body 20 of the bra 10. The rear panel is comprised of two cups, a right rear cup 180 and a left rear cup 190. Each cup 180, 190 has an opening 200 that encompasses the nipple portion of each breast of the person wearing the bra. The opening 200 surrounds the nipple portion of the breast providing support to breast while still allowing access for feeding purposes. The rear panel 120 of the body 20 extends out the full width of the body 20, hence also having rear wing portions 55, 65 which coexist in a mating fashion with rear wing portions 50, 60 of the front panel 110. In other words the rear panel 120 and the front panel 110 are similar to two separate and complete bras that are matingly connected or coexist with one another to form one complete and supportive bra 10. In the preferred embodiment, the front panel 110 and the rear panel 120 are sewn together along the bottom edge of each panel with seam 210. However, in alternative embodiments, it is possible for the front panel 110 and the rear panel 120 to be sewn together along either the top edge or at the sides of the bra 10 and the bottom edges of each panel left separate from the other panel. This may occur when the front panel 110 is removably connected at the middle of the front panel 110 or at the sides of the front panel 110 as described in later embodiments.

Figure 3:
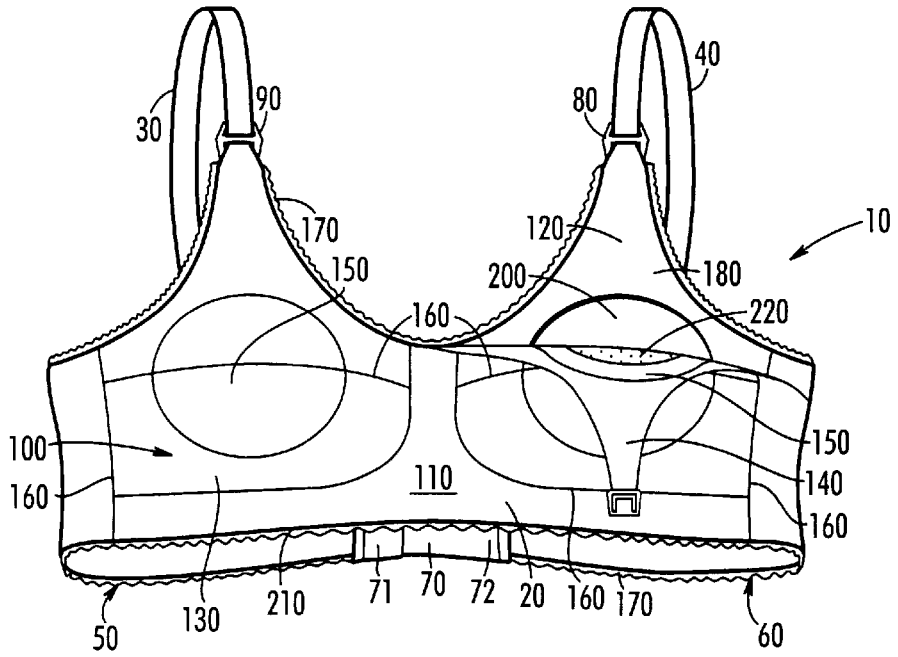
FIG. 3 is a front perspective view of the nursing bra with a front panel partially folded down for illustrative purposes and exposing a portion of the rear panel.

FIG. 3 is a front perspective view of the nursing bra 10 wherein a portion of the left front cup 1 40 is disconnected at connector 80 from the strap 40 and folded forward exposing the right rear cup 180 and the opening 200 in the rear panel 120. A portion of the pocket 150 and the absorbing panel 220 of the front panel 110 of the bra 10 are also shown in the folded down portion of the front panel 110.

Figure 4:
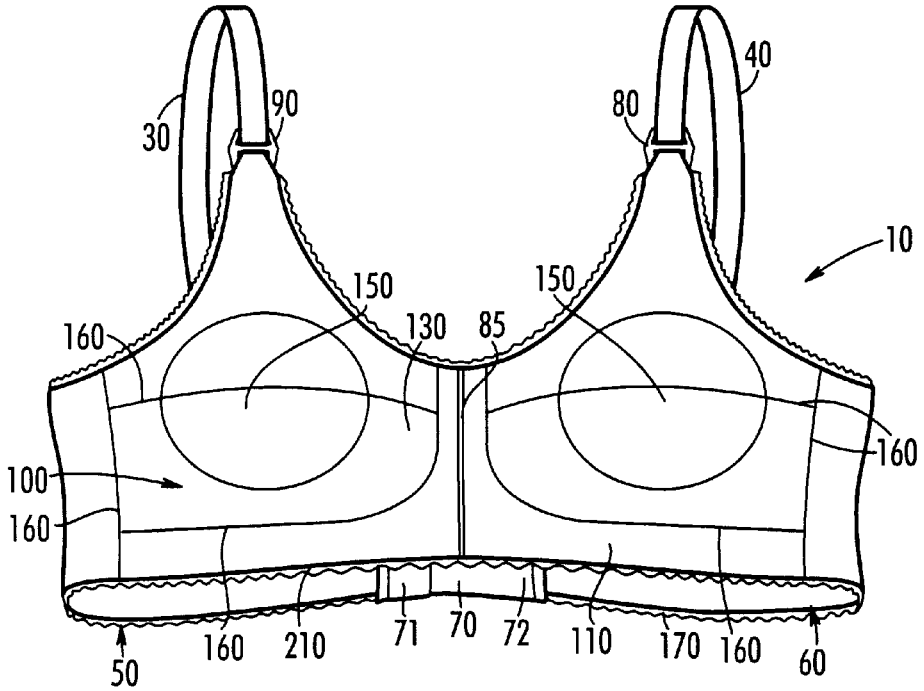
FIG. 4 is a front perspective view of a second embodiment of the nursing bra.

FIG. 4 is a front perspective view of a second embodiment of the nursing bra. The second embodiment differs from the first embodiment by the type and location of connecting means used to connect the front panel 110 of the bra with the rear panel 120. This second embodiment also has a connecting means 85 located in the middle of the front panel 110 of the bra in addition to connectors 80,90 at the top portion of the bra where the both the front panel 110 and rear panel 120 are connected to the straps 30,40. This middle connecting means 85 can be of a variety of conventional types of fasteners such as, but not limited to, snaps, buttons, zippers, string ties or hook and loop fasteners such as VELCRO. Having the middle connecting means 85 in the middle of the bra allows for easy access to the rear panel 120, yet is convenient and comfortable. The front panel 110 can be either permanently or removably connected to the rear panel 120 at a number of locations such as: along the bottom as in the first embodiment; along both sides of the body 20 in the area that would be under the wearer' arms also known as the rear wing portions 50,60 of the front panel 110 and 55,65 of the rear panel 120; in the back where the rear connecting means 70 is located; in the front of the bra 10 at the top with connecting means 80,90; or it can simply be tacked, snapped or otherwise attached, in various locations of the body 20 that would enable the front panel 110 and the rear panel 120 to remain matingly matched yet accessibility to the rear panel 120 for nursing.

Figure 5:
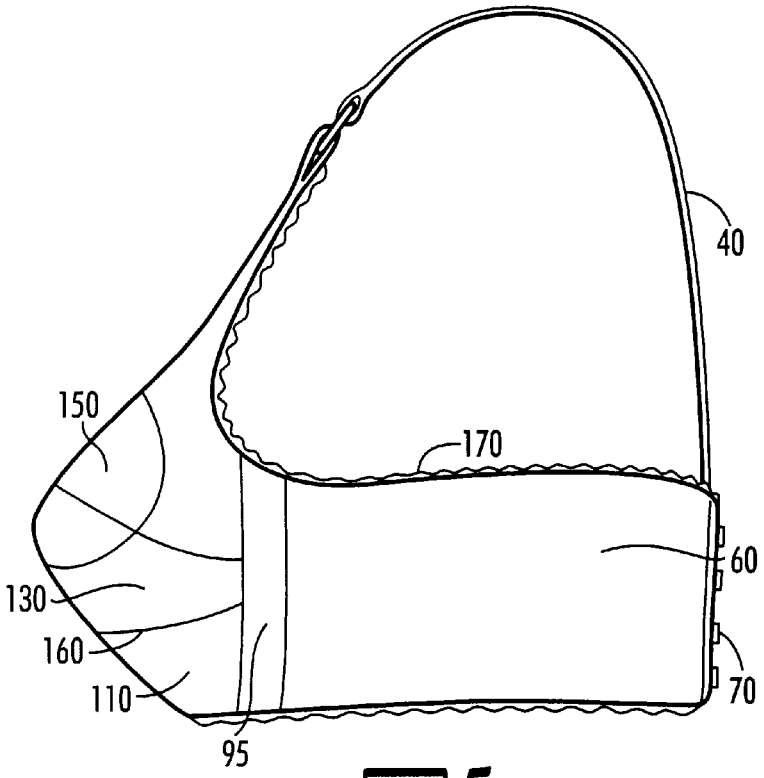
FIG. 5 is a side elevation view of a third embodiment of the nursing bra, the opposite side being a mirror image thereof.

FIG. 5 is a side elevation view of a third embodiment of the nursing bra, the opposite side being a mirror image thereof. This third embodiment is similar to the first two embodiments and also has a the removable connecting means 95 located on the rear wing portions 50,60 of the front panel 110 of the bra 10. Again, the side connecting means 95 is of a conventional type such as those listed for the middle connecting means 85, with their location being one on each side of the bra instead of the front portion 100. Locating the side connecting means 95 on both sides of the bra allows for easy access and comfort.

Figure 6:
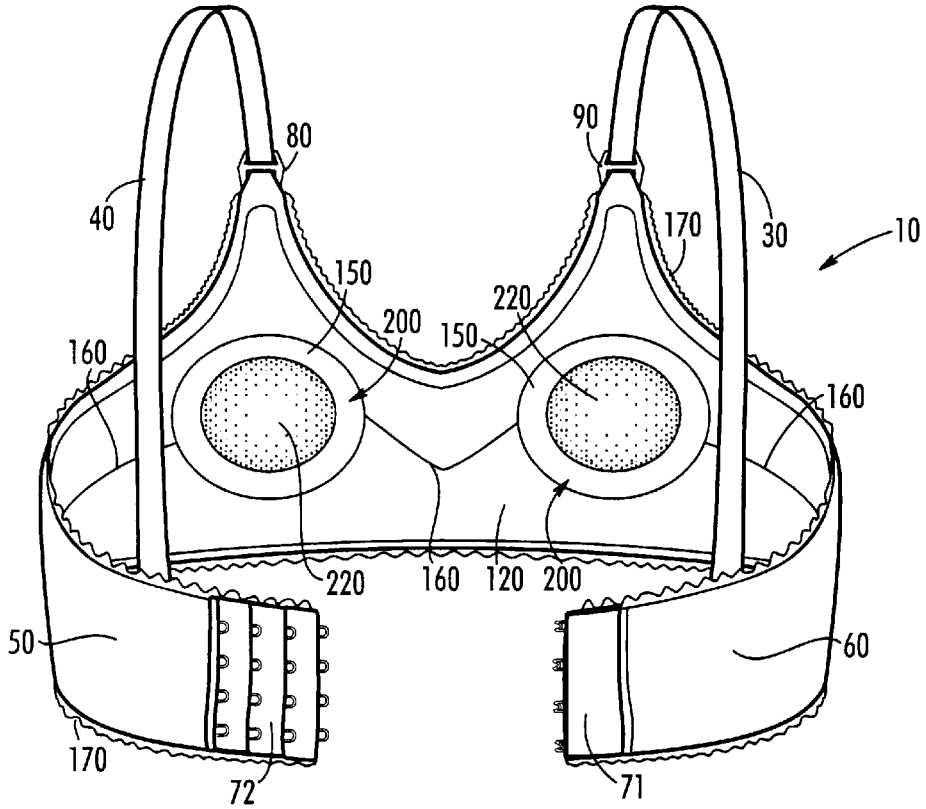
FIG. 6 is a rear perspective view of the nursing bra.

FIG. 6 is a rear perspective of the bra 10. The rear panel 120 of the bra 10 is connected to strap 30 with connector 90 and connected to strap 40 with connector 80. Connectors 80, 90 are of conventional connectors known in the art of bras which allow for a multiple connection to occur at one location. In this case the rear panel 120 is connected to the straps 30, 40 of the bra 10 while the front panel 110 is removably connected to the straps 30, 40 and rear panel 120 at the same locations. The rear panel 120 also has supportive seams 160 that extend from wings 55, 65 to the openings 200 and also between the opening 200. Openings 200 are apertures in the rear panel 120 wherein the material has been removed that allow for a window through which the nipple portion of each breast protrudes allowing access to the nipple for nursing a baby.

Figure 7:
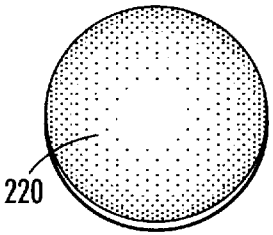
FIG. 7 is a rear perspective view of a moisture absorbing panel.

FIG. 7 is a perspective view of the moisture absorbing panel 220. While the moisture absorbing panel 220 in the preferred embodiment is circular in shape, so as to match the same shape as the pockets 150, any shape that is convenient may be used as is also the case with the shape of the pockets 150. In other words, should one desire, the shape of the pockets 150 could be square, rectangular, triangular or any other appropriate shape and the moisture absorbing panel 220 will be the same corresponding shape such as square, rectangular, triangular, and etc.

The nursing bra 10 described herein and illustrated in the drawings is subject to other advantages and modifications that may be apparent to those of ordinary skill in the art without departing from the spirit and scope of the appended claims. Accordingly, the invention is to be limited only by the scope of the following claims and their equivalents.

What is claims is:

1. A nursing bra comprised of:

a body having a front panel and a rear panel, said front panel being the same size as said rear panel, said body having at least two ends;

at least two moisture absorbing panels;

a pair of straps connected to said rear panel and removably connected to said front panel by at least two removable connecting means;

a rear connecting means for connecting each said end of said body; and at least two holding means in said front panel for holding said at least two moisture absorbing panels;

wherein said bra provides support and a moisture absorbing means for a person wearing said bra.

2. The nursing bra of claim 1, wherein:

said front panel having a right front cup and a left front cup, each front cup having one of said holding means for holding said moisture absorbing panels, said holding means being a pocket;

said rear panel having a right rear cup and a left rear cup, each rear cup having an opening therein;

said front panel being connected to said rear panel by a seam along the bottom edge of each panel; and said front panel removably connected to said rear panel by said removable means.

3. A nursing bra, comprised of:

a body having a front panel and a rear panel, said front panel having two cups, each cup having a pocket for holding a moisture absorbing panel in each pocket;

at least two moisture absorbing panels;

said rear panel having two cups, each cup having an opening formed therein for surrounding and exposing a nipple portion of a person wearing said bra;

said front panel having two front panel wing portions;

said rear panel having two rear panel wing portions;

said front panel being connected to said rear panel along the bottom of said body and removably connected to said rear panel and said straps by two connecting means;

a rear connecting means for connecting said front panel wing portions and said rear panel wing portions to each other; and two straps connected to said front panel and said rear panel;

wherein said bra provides support for a wearer's breasts and moisture absorbing means for fluids from said breasts.

4. A nursing bra comprised of:

a body having a front panel and a rear panel, said front panel being the same size as said rear panel, said body having two ends;

at least two moisture absorbing panels;

a pair of straps connected to said rear panel and said straps connected to said front panel by at least two connecting means;

a rear connecting means for connecting each end of said body; and said front panel holding said at least two moisture absorbing panels;

said front panel having a connecting means that can be disconnected and allow access to said rear panel of said body;

wherein said bra provides support and a moisture absorbing means for a person wearing said bra.

5. The nursing bra of claim 4, wherein:

said front panel having a right front cup and a left front cup, each front cup having a pocket for holding said moisture absorbing panels;

said rear panel having a right rear cup and a left rear cup, each rear cup having an opening therein;

said front panel having two wing portions;

said rear panel having two wing portions;

said front panel being connected to said rear panel at said wing portions;

said connecting means being located in the front of said front panel between said right front cup and said left front cup;

wherein said front panel and said rear panel mating coexist to provide said support and comfort.

6. The nursing bra of claim 4, wherein:

said front panel having a right front cup and a left front cup, each front cup having a pocket for holding said moisture absorbing panels;

said rear panel having a right rear cup and a left rear cup, each rear cup having an opening therein;

said front panel having two wing portions;

said rear panel having two wing portions;

said front panel being connected to said rear panel between said right front cup and said left front cup;

said connecting means being located on each of said wing portions of said front panel;

wherein said front panel and said rear panel mating coexist and said connecting means can be disconnected allowing access to either the right rear cup or the left rear cup whichever is preferred.

* * * * *